US005765259A

United States Patent [19]

Cika

[11] Patent Number: 5,765,259

[45] Date of Patent: Jun. 16, 1998

[54] VACUUM NOZZLE FOR CLEANING CEILING FAN BLADES

[76] Inventor: Christina L. Cika, 6303 Dartworth Dr., Parma, Ohio 44129

[21] Appl. No.: 819,474

[22] Filed: Mar. 17, 1997

[51] Int. Cl.[6] ..... A47L 9/06

[52] U.S. Cl. ..... 15/394; 15/396; 15/398

[58] Field of Search ..... 15/398, 394, 396

[56] References Cited

U.S. PATENT DOCUMENTS

| | | | |
|---|---|---|---|
| D. 296,022 | 5/1988 | Restivo | D32/35 |
| D. 304,106 | 10/1989 | Dobson et al. | D32/40 |
| D. 341,452 | 11/1993 | Songer | D32/33 |
| 1,669,302 | 5/1928 | Lanman | 15/394 |
| 2,276,264 | 3/1942 | Goldfinger | 15/210 |
| 2,277,444 | 3/1942 | McPhee | 15/160 |
| 2,599,420 | 6/1952 | Westhoff et al. | 15/394 |
| 2,608,710 | 9/1952 | Zaidan | 15/394 |
| 2,639,454 | 5/1953 | Dory | 15/245 |
| 2,652,583 | 9/1953 | Tomanica | 15/394 |
| 2,659,924 | 11/1953 | Forsberg | 15/395 |
| 2,697,642 | 12/1954 | Rudy | 306/1 |
| 2,804,640 | 9/1957 | Zaidan | 15/394 |
| 3,110,923 | 11/1963 | Berleme | 15/394 |
| 3,381,334 | 5/1968 | Redmond | 15/229 |
| 3,653,425 | 4/1972 | Elliott et al. | 164/89 |
| 3,989,388 | 11/1976 | Sparr, Sr. | 401/11 |
| 4,458,375 | 7/1984 | Killeen | 15/236 |
| 4,756,050 | 7/1988 | Vesely | 15/394 |
| 4,787,118 | 11/1988 | Weiland et al. | 15/394 |
| 4,823,431 | 4/1989 | Carpenter | 15/394 |
| 4,827,556 | 5/1989 | Corsetti | 15/244.1 |
| 4,841,592 | 6/1989 | Restivo | 15/210 |
| 5,018,944 | 5/1991 | Bielecki et al. | 416/146 |
| 5,116,151 | 5/1992 | Lytton et al. | 401/9 |
| 5,235,722 | 8/1993 | Harris et al. | 15/394 |
| 5,313,687 | 5/1994 | Schneider | 15/394 |
| 5,319,821 | 6/1994 | Nicholson et al. | 15/104.8 |
| 5,337,445 | 8/1994 | Harris et al. | 15/394 |
| 5,359,751 | 11/1994 | Bellardini | 15/394 |
| 5,488,754 | 2/1996 | Shadley | 15/394 |

*Primary Examiner*—Chris K. Moore
*Attorney, Agent, or Firm*—David A. Burge

[57] ABSTRACT

A vacuum nozzle has an elongate, tubular handle with an open end for connection to a vacuum cleaner hose, and has a hollow, generally rectangular head connected to the handle's opposite end. The head defines a transversely extending blade passage of generally rectangular cross-section through which portions of a ceiling fan blade can be inserted for cleaning. Extending perimetrically about the blade passage are head portions that include parallel top and bottom bars that have overlying left and right ends connected by left and right end structures, all of which are hollow and communicate to define a generally rectangular vacuum chamber that communicates with the hollow interior of the tubular handle. The top and bottom bars and the left and right end structures respectively carry top, bottom, left and right bristles that project into the blade passage at spaced locations near opposite ends of the blade passage. Discrete openings communicate the blade passage with the vacuum chamber for ducting dust from top, bottom, left and right blade surfaces into top, bottom, left and right portions of the vacuum chamber, with the number, size and positions of these openings being selected to ensure that the vacuuming action of the nozzle is maximized where dust tends most to collect, namely along top and edge surfaces of a blade.

20 Claims, 4 Drawing Sheets

VACUUM NOZZLE FOR CLEANING CEILING FAN BLADES

CROSS-REFERENCE TO CONCURRENTLY-FILED APPLICATION

Reference is made to design application Ser. No. 29/068,654 filed Mar. 17, 1997 entitled NOZZLE FOR CLEANING CEILING FAN BLADES which relates to an external appearance that may be exhibited by vacuum nozzles that embody features of the present invention, the disclosure of which application is incorporated herein by reference.

BACKGROUND OF THE INVENTION

1. Field of the Invention

The present invention relates to a vacuum nozzle for cleaning ceiling fan blades and the like that features a generally rectangular, hollow head connected to an elongate, tubular handle—wherein the head 1) defines a transversely extending blade passage of generally rectangular cross-section through which portions of a ceiling fan blade can be inserted for cleaning, 2) is comprised of head portions that perimetrically surround the blade passage including parallel top and bottom bars that have overlying left and right ends connected by left and right end structures, all of which are hollow and communicate to define a generally rectangular vacuum chamber that extends perimetrically about the blade passage and communicates with the hollow interior of the tubular handle, 3) with the top and bottom bars and the left and right end structures respectively carrying top, bottom, left and right sets of bristles that project into the blade passage at spaced front and rear locations near opposite ends of the blade passage, and, 4) with discrete top, bottom, left and right sets of openings being defined by the head that communicate the blade passage with the vacuum chamber for ducting dust from top, bottom, left and right blade surfaces into top, bottom, left and right portions of the vacuum chamber. More particularly, the present invention relates to a vacuum nozzle of the type just described that utilizes discrete top, bottom, left and right vacuum openings for communicating the blade passage with a surrounding vacuum chamber, wherein the number, size and positions of these openings are selected to ensure that the vacuuming action of the nozzle is maximized where dust tends most to collect, namely along top and edge surfaces of a blade.

2. Prior Art

A variety of vacuum cleaner attachments have been proposed that are intended to be connected to vacuum cleaner hoses to facilitate the removal of dust, cobwebs and the like from the relatively long, thin, flat blades of ceiling fans. While a number of these proposals employ hollow heads that position resilient media such as foam material and/or brush bristles to concurrently engage opposite sides of fan blades, these prior proposals typically suffer from one or a combination of drawbacks including a failure to make optimum and judiciously concentrated use of available vacuuming action to ensure that surface areas of ceiling fan blade areas where dust most tends to collect are most vigorously vacuumed.

Dust and cobwebs principally tend to collect on upwardly facing blade surfaces, and on blade edge surfaces. Relatively little dust tends to collect on downwardly facing blade surfaces. It is therefore desirable for the vacuuming action of a blade cleaning nozzle to concentrate available vacuuming action so as to remove dust and cobwebs from top surfaces and edge surfaces of ceiling fan blades. Many prior nozzle proposals provide vacuum chambers that open widely as they face toward bottom, edge and top surfaces of a fan blade—which tends to cause available vacuuming action to be dissipated and inappropriately squandered generally about the perimeter of a fan blade rather than to optimize the exposure of the vacuuming action to the blade by judiciously concentrating the application of vacuuming action along top and edge surfaces of ceiling fan blades where it is most needed.

Some prior nozzle proposals advantageously use tubular handles to deliver vacuum action to nozzle heads—which often is carried out by employing a handle-to-head connection located along bottom portions of a nozzle head so that a person who is standing beneath a ceiling fan can utilize the elongate, tubular handle to raise and position the nozzle head adjacent an overhead fan blade that is to be cleaned by vacuum action. Because these proposals have their handle-to-head connections located along bottom portions of nozzle heads, the vacuum action that is delivered by the head to a blade tends to be concentrated along bottom surface portions of the blade where it is least needed. Prior proposals that employ handle-to-head connections located along bottom portions of heads and that take no suitable measures to concentrate the application of vacuum force along top and edge surfaces of ceiling fan blades typically exhibit diminished blade cleaning performance.

A sizable number of prior proposals deploy their vacuuming action at substantially the same locations where bristles and/or other resilient scrubbing/wiping media such as resilient foam rubber are situated. Nozzles that deploy available vacuuming action among or within very close proximity to resilient media often deliver diminished vacuuming action to blade surfaces for the simple reason that the media itself obstructs and offers air flow resistance that diminishes the vacuum force that could otherwise be presented to fan blade surfaces for withdrawing dust and the like therefrom. Other prior nozzle proposals deploy their vacuuming action at locations spaced so far from the locations of brushing and/or wiping media that available vacuum force is prevented from optimally grasping and ducting away dust, cobwebs and the like that are loosened from blade surfaces by the wiping and/or brushing action. Thus, a consideration that needs to be kept better in mind in designing vacuum nozzles for cleaning ceiling fan blades is that resilient media for wiping and/or brushing blade surfaces should operate within reasonably close proximity to where vacuum force is applied to blade surfaces, but the resilient media should not detrimentally inhibit flow at vacuum force application sites nor otherwise inappropriately diminish the administration of a vigorous vacuuming action.

Resilient media can and should be used effectively to brush and/or wipe blade surfaces reasonably thoroughly to loosen and to begin to remove dust, cobwebs and the like therefrom. However, the task of withdrawing loosened foreign matter and of picking up remaining dust on blade surfaces should be accomplished by the vacuuming action of the nozzle—which requires that the vacuuming action be carried out most vigorously within the vicinities of blade surfaces where the resilient media encounters and loosens the largest quantities of foreign matter, and where there are most likely to remain some quantities of dust that need to be withdrawn directly from blade surfaces by the vacuuming action itself. The present invention seeks to accomplish these objectives more efficiently and effectively than it has been achieved by prior proposals while, at the same time, providing a nozzle that can be manufactured at a reasonable cost, and that can be made sufficiently light in weight for ease of use.

In preferred practice, vacuum nozzles that embody features of the invention also employ a tapered tubular handle that facilitates connecting the nozzle to a variety of conventional vacuum hose diameters of the type commonly used by hand-held, floor-style, shop-type and built-in vacuum units and systems that are found in modern homes. Ceiling fans now are being used from attics to basements and in garage workshops, and vacuum nozzles need to be capable of being used with a variety of vacuum hose sizes so that substantially any conveniently available vacuum cleaner can be employed to operate these nozzles—so that a particular vacuum cleaner does not need to be carried up and down flights of stairs when the time is at hand to vacuum clean ceiling fan blades.

SUMMARY OF THE INVENTION

The present invention addresses the foregoing and other needs, drawbacks and shortcomings of the prior art by providing a vacuum nozzle has an elongate, tubular handle with an open end for connection to a vacuum cleaner hose, and has a hollow, generally rectangular head connected to the handle's opposite end. The head defines a transversely extending blade passage of generally rectangular cross-section through which portions of a ceiling fan blade can be inserted for cleaning. Extending perimetrically about the blade passage are head portions that include parallel top and bottom bars that have overlying left and right ends connected by left and right end structures, all of which are hollow and communicate to define a generally rectangular vacuum chamber that communicates with the hollow interior of the tubular handle. The top and bottom bars and the left and right end structures respectively carry top, bottom, left and right bristles that project into the blade passage at spaced locations near opposite ends of the blade passage. Discrete openings communicate the blade passage with the vacuum chamber for ducting dust from top, bottom, left and right blade surfaces into top, bottom, left and right portions of the vacuum chamber.

A feature of the preferred practice of the present invention resides in providing an arrangement of discrete vacuum openings (i.e., the openings that communicate the blade-receiving passage of the nozzle with a vacuum chamber that is defined within the hollow head of the nozzle so as to perimetrically ring the blade-receiving passage), wherein the size, number and positioning of these openings serves to optimally, judiciously concentrate the application of vacuum action to top and edge surfaces of a ceiling fan blade where it is needed most.

A further feature of the preferred practice of the present invention resides in ensuring that the cross-sectional area of the vacuum chamber that is defined within the hollow head of the nozzle is properly coordinated with the size, number and symmetry of location of the discrete openings to ensure that a substantially uniform vacuum is maintained within the vacuum chamber during nozzle operation—so that the vacuum openings can, in fact, administer a desired type of vacuuming action for effectively withdrawing dust, cobwebs and the like from top, bottom and edge surfaces of a ceiling fan blade that is inserted through the blade receiving passage of the head.

In preferred practice, the vacuum capability that is delivered to the vacuum chamber at the juncture of the tubular handle with central portions of a bottom bar of the head is "divided" so that half is delivered toward a left end structure of the head, and half toward a right end structure of the head—whereby substantially symmetrical flows tend to be established in symmetrically configured left and right "halves" of the head, with each of the the left and right end structures functioning to deliver vacuum forces of substantially equal magnitudes to opposite end regions of the top bar of the head. This "halving" and "symmetrical delivery" of vacuuming action is further facilitated by configuring substantially all of the physical features of the nozzle so that they are left-to-right symmetrical about a longitudinally extending center axis of the handle.

In preferred practice, delivering a maximum of vacuuming action to top surface portions of a fan blade that is inserted through the blade passage of the nozzle preferably is ensured both by 1) ensuring that a substantially uniform vacuum pressure is held throughout the vacuum chamber, and 2) by providing top bar vacuum openings (that communicate the vacuum chamber with top portions of the blade passage) that have a total cross-sectional area that bears a proper relationship to the total cross-sectional areas of other vacuum openings that are defined by each of the bottom bar, the left end structure and the right end structure of the nozzle head.

A "rule of thumb" that preferably is used to guide the determination of the cross-sectional area of the vacuum chamber, and that preferably is used to determine the size and number of vacuum openings along each of the four sides of the blade passage is as follows:

1) The cross-sectional area of the vacuum chamber that extends perimetrically about the blade passage of the head preferably does not diminish at any point along the endless length thereof to a cross-sectional area that is less than one half the total cross-sectional areas of all of the vacuum openings that communicate the vacuum chamber with the blade passage. This arrangement helps to ensure that each left and right "half" of the vacuum chamber is capable of delivering adequate vacuum force to its associated "half" of the total number of vacuum openings of the head.

2) The total cross-sectional area of the top bar's vacuum openings is greater than the total cross-sectional area of the vacuum openings that are formed in any one of the other three bar-like portions of the head (namely the bottom bar, the left end structure and the right end structure). This arrangement helps to ensure that a greater abundance of vacuuming capability is delivered along top surface portions of the blade than along any of the other blade surfaces.

3) The total cross-sectional areas of the vacuum openings formed in each of the left and right end structures are substantially equal (one to the other), with each being greater than the total cross-sectional area of the vacuum openings that are formed in the bottom bar. This arrangement helps to ensure that left and right edge surfaces of an inserted blade are subjected to substantially equal vacuum force applications, that the vacuum force applications effected by each of the left and right sets of vacuum openings are greater than the vacuum force application that is effected by the bottom bar's vacuum openings, and that the vacuum openings formed in the left and right end structures are not of such large size as to unduly diminish the vacuum force that is delivered by the left and right end structures to opposite ends of the top bar of the head.

4) The vacuum openings that are formed in the bottom bar of the head are symmetrically located along the left-to-right extending length of the bottom bar and are sized such that half of their total cross-sectional area is located to the left and half to the right of the juncture of the bottom bar and the handle. This left-to-right symmetry of location and sizing of the bottom bar vacuum openings, combined with the fact that the total cross-sectional area of the bottom bar vacuum openings is less than the total cross-sectional areas of the vacuum openings located in any of the top bar, the left end structure and the right end structure, promotes desired flow symmetry and minimizes the application of vacuum force to the bottom surface of a blade that is inserted into the blade passage of the head.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figure 1:
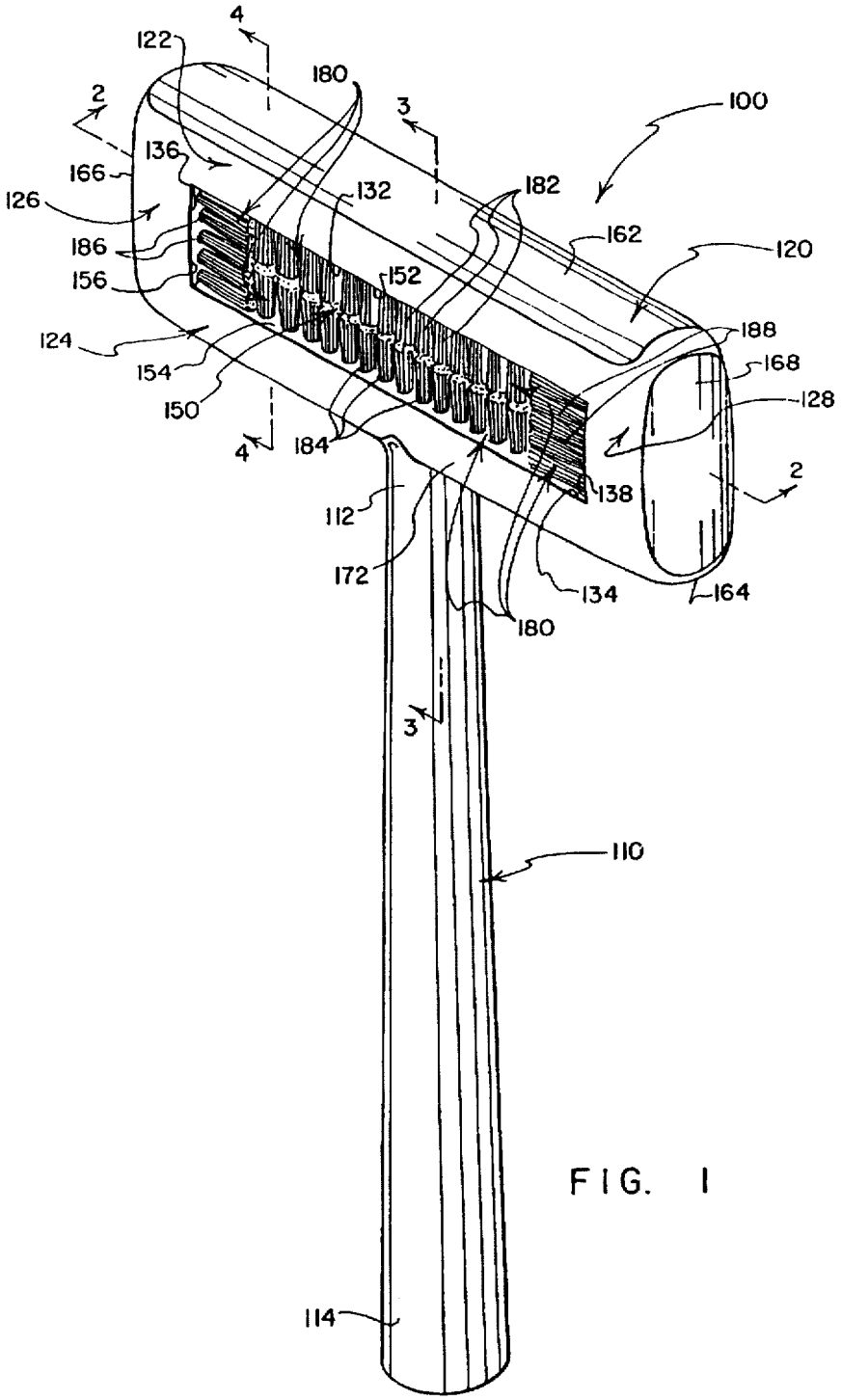
FIG. 1 is a perspective view of a vacuum nozzle that embodies the best mode known to the inventor for carrying out the preferred practice of the present invention.

Referring to FIG. 1, a vacuum nozzle for cleaning ceiling fan blades that embodies the preferred practice of the present invention is indicated generally by the numeral 100. The nozzle 100 has an elongate tubular handle 110 connected to a generally rectangular head 120. Interior portions of the head 120 surround a centrally located blade receiving passage 150. Bristles 180 are carried by the head 120 and extend into the blade passage 150 generally toward central portions of the passage 150.

Figure 7:
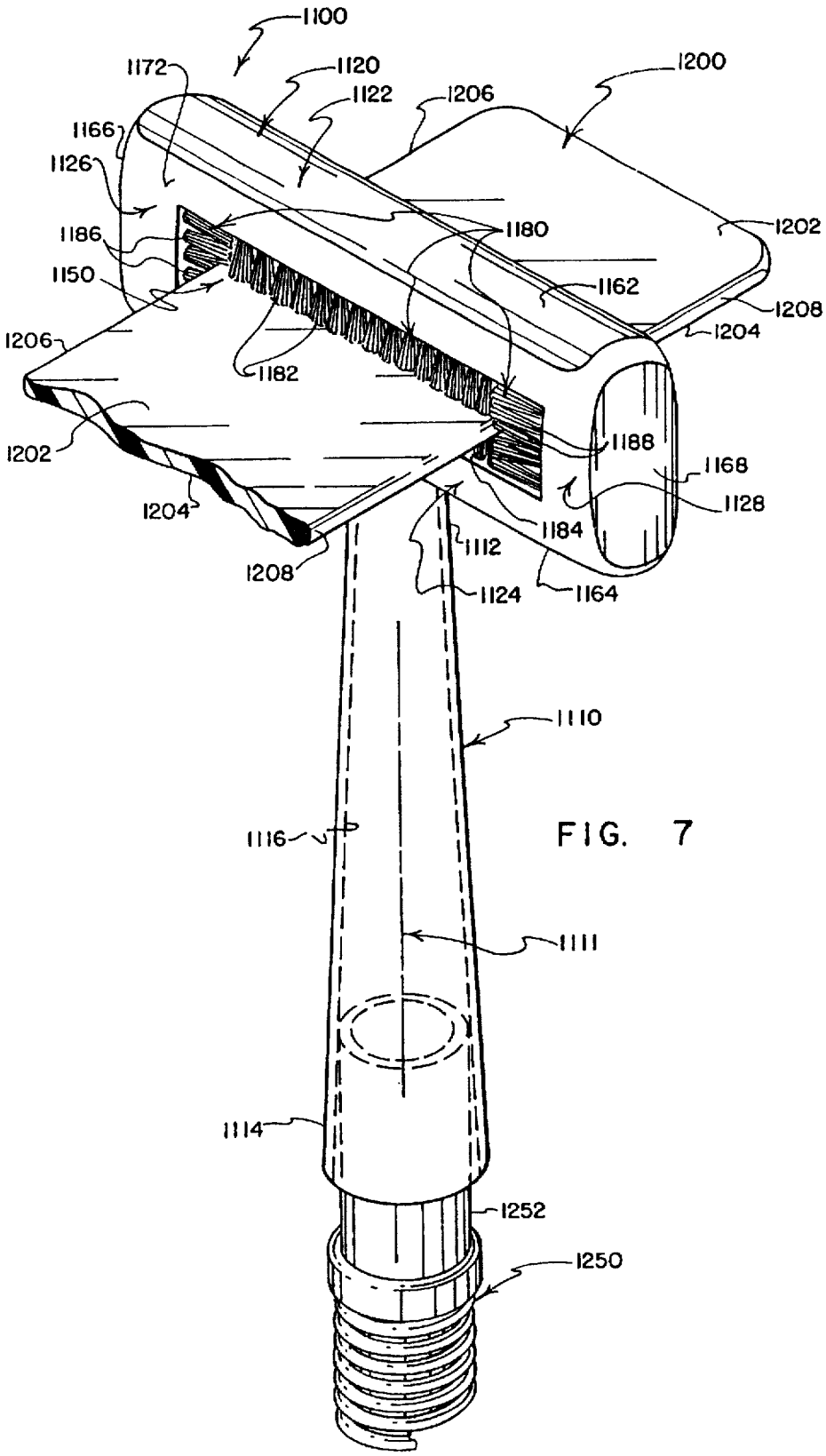

Referring to FIG. 7, a second nozzle embodiment 1100 is shown that also incorporates features of the present invention. The nozzle 1100 has a head 1120 that is identical in all respects to the head 120 of the nozzle 100; and has a handle 1110 that is much like the handle 110 of the nozzle 100 except that it employs a greater taper. In fact, the only difference between the nozzles 100, 1100 resides in the taper of their handles 110, 1110 which causes the bottom end region 1114 of the handle 1110 to define a larger diameter end opening that will receive and connect with larger diameter vacuum hoses than can be accommodated by the smaller diameter end opening of the bottom end region 114 of the handle 110. By judiciously selecting the diameters and tapers of the interior surfaces 116, 1116 of the handles 110, 1110, hose end regions of a desired range of diameters of conventional vacuum cleaner hoses can be made to releasably connect with the nozzle handles 110, 1110. A typical manner in which an end region 1252 of a conventional vacuum cleaner hose 1250 can be releasably connected to (i.e., can be received within and wedgingly, frictionally engaged with the tapered interior surface 1116 of) the lower end region 1114 of the handle 1110 is depicted in FIG. 7 by hidden lines.

Because all components of the second nozzle embodiment 1100 find correspondence with the components of the first nozzle embodiment 110 (i.e., they correspond in configuration and are substantially identical in the manner in which they function), the components of the nozzle 1100 (as depicted in FIG. 7) are designated by the same numerals that are used to designate corresponding components of the nozzle 110 (as depicted in FIGS. 1–6)—except that the number "one thousand" has been added to the numerals that designate features of the second nozzle 1100. Thus, corresponding handles of the nozzles 100, 1100 are designated by the numerals 110, 1110; corresponding heads are designated by the numerals 120, 1120; corresponding blade passages are designated by the numerals 150, 1150; corresponding bristles are designated by the numerals 180, 1180; etc. Inasmuch as components of the nozzle 1100 correspond in function and configuration to the components of the nozzle 100, it will be understood that what is said herein about components of either of the nozzles 100, 1100 therefore has corresponding application to the components of the other of the nozzles 100, 1100.

Referring to FIG. 7, the nozzle 1100 is shown with its head-carried bristles 1180 extending into engagement with outer surface portions of a ceiling fan blade 1200 that extends through the blade passage 1150 of the head 1120. The fan blade 1200 has top and bottom surfaces 1202, 1204 that are engaged principally by top and bottom rows 1182, 1184 of the head-carried bristles 1180; and, the fan blade 1200 has left and right edge surfaces 1206, 1208 that are engaged principally by left and right rows 1186, 1188 of the head-carried bristles 1180—it being noted, however, that portions of the top and bottom surfaces 1202, 1204 that are located near the edge surfaces 1206, 1208 may be engaged by combinations of bristles from the top row 1182 and one or the other of the edge rows 1186, 1188; or by combinations of bristles from the bottom row 1184 and one or the other of the edge rows 1186, 1188.

If the blade 1200 were not as wide as is depicted in FIG. 7 (i.e., if its edge surfaces 1206, 1208 were not spaced as far apart as depicted), the left edge surface 1206 could be engaged by left bristles 1186 when the head 1120 is moved longitudinally along the blade 1200 in one direction (so that the left edge surface 1206 would be "brushed" to loosen dust thereon during one direction of movement of the head 1120 along the blade 1200), and the right edge surface 1208 could be engaged by right bristles 1188 when the head 1120 is moved longitudinally along the blade 1200 in the opposite direction (so that the right edge surface 1208 would be "brushed" during opposite direction movement of the head 1120).

Alternatively, the head 1120 can be "cocked" slightly (by rotating it about the handle axis 1111)—by which arrangement at least some of the left bristles 1186 and some of the right bristles 1188 can be brought concurrently into engagement with the left and right edge surfaces 1206, 1208, respectively, to concurrently brush the edge surfaces 1206, 1208 regardless of which direction the nozzle head 1120 is moved along the length of the ceiling fan blade 1200. Thus, the blade passages 150, 1150 can be made significantly wider (measured left to right) than are fan blades that are to be brushed (by the bristles 180, 1180 of the heads 120, 1120, respectively, when the fan blades are inserted through the blade passages 150, 1150) without causing a loss of brushing effectiveness.

Inasmuch as the handles 110, 1110 connect identically with the heads 120, 1120, and inasmuch as the heads 120, 1120 are identical in all respects, the description which follows concentrates on the nozzle 100 (as depicted in FIGS. 1–6) but will be understood to apply equally to the nozzle 1110 (as depicted in FIG. 7).

While the handle 110 and the head 120 are depicted in the drawings as being formed from a single piece of relatively rigid plastics material, it will be understood that various portions of the nozzle 100 can be fabricated separately and then suitably joined by chemical bonding, sonic welding or a variety of other conventional connection techniques. Likewise, while portions of the nozzle 100 are depicted in the drawings as having relatively simple shapes and as employing material cross-sections of a variety of thicknesses, it will be understood that more precisely engineered shapes and different cross-sectional configurations may be employed without departing from the spirit and scope of the invention, for example to make use of smaller quantities of plastics material and/or to minimize problems associated with shrinkage, uneven cooling and the like that may be encountered if the nozzle 100 or portions thereof are to be injection molded or otherwise formed by techniques that may benefit from shape change or cross-sectional modification.

Figure 2:
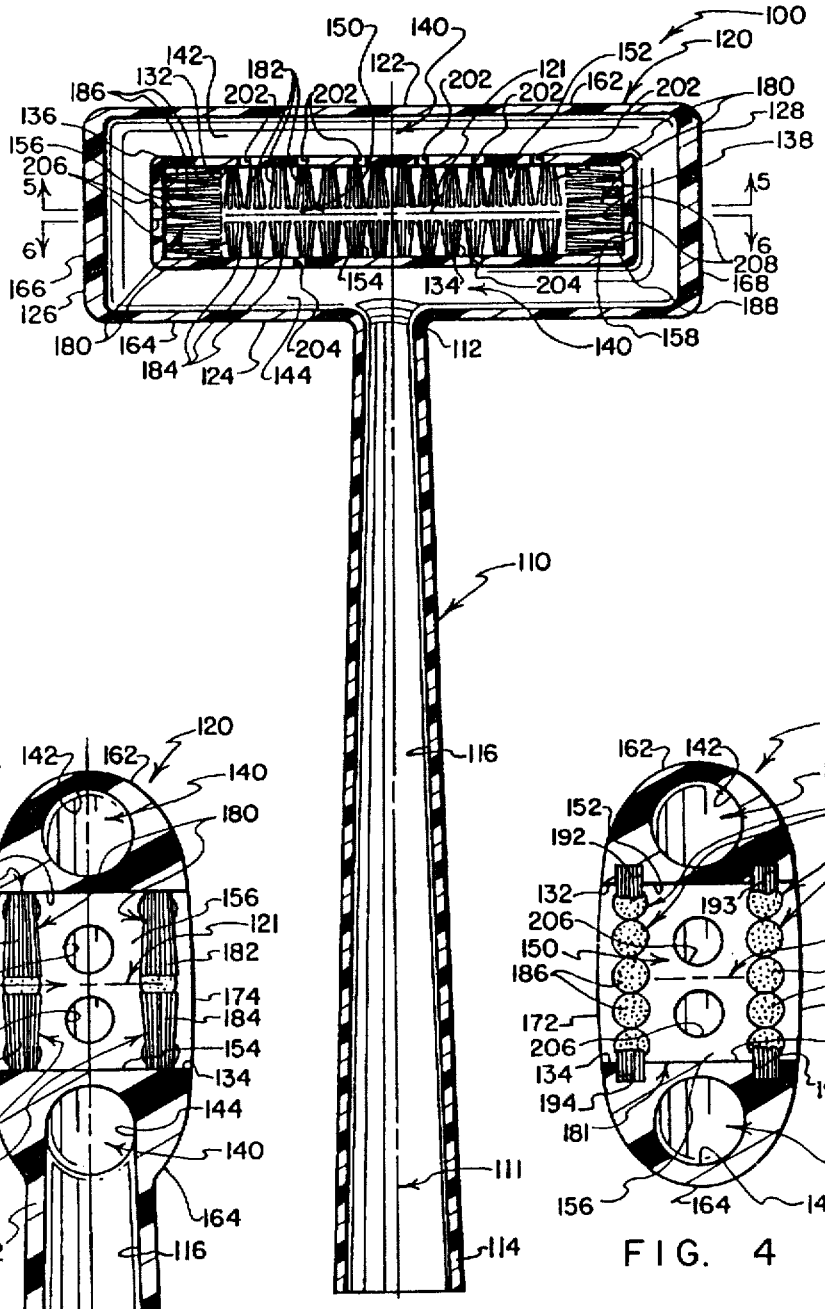
FIG. 2 is a cross-sectional view thereof, as seen from a plane indicated by a line 2—2 in FIG. 1.

Referring to FIG. 2, the hollow interior of the handle 110 communicates centrally with an elongate bottom region 144 of a generally rectangular chamber 140 that is defined by the hollow interior of the head 120. The bottom region 144 communicates at opposite ends with left and right upwardly extending end regions 146, 148 of the chamber 140; and, the left and right end regions communicate with opposite ends of an elongate upper region 142 of the chamber 140.

The upper region 142 is defined by a top bar portion 122 of the head 120. The lower region 144 is defined by a bottom bar portion 124 of the head 120. The left and right end regions 146, 148 are defined, respectively, by left and right end structures 126, 128 of the head 120. The top bar 122 has a bottom surface 132 that defines the top side 152 of the blade passage 150. The bottom bar 124 has a top surface 134 that defines the bottom side 154 of the blade passage 150. The left and right end structures 126, 128 have opposed surfaces 136, 138 that face toward each other for defining left and right sides 156, 158 of the blade passage 150.

Figure 3:
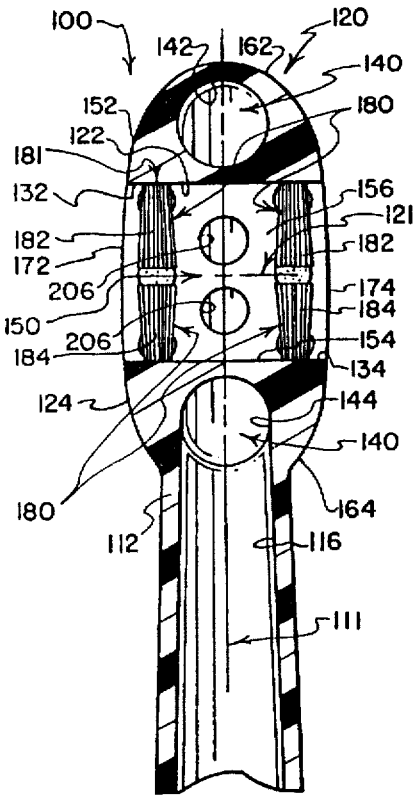
FIG. 3 is a cross-sectional view showing portions of the head and handle thereof, as seen from a plane indicated by a line 3—3 in FIG. 1.
Figure 4:
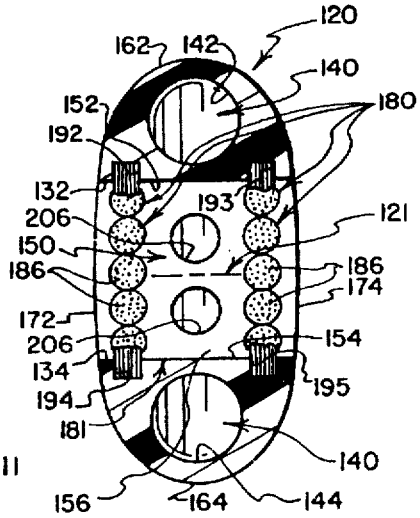
FIG. 4 is a cross-sectional view showing portions of the head, as seen from a plane indicated by a line 4—4 in FIG. 1, with inner end portions of top and bottom bristles broken away to permit left end bristles to be viewed.
Figure 5:
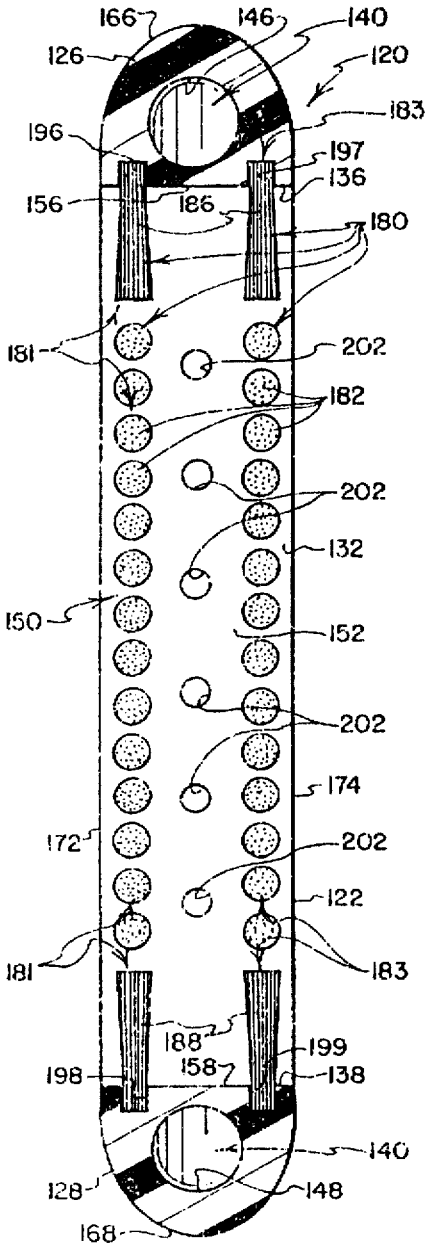
FIG. 5 is a cross-sectional view showing portions of the head, as seen from a plane indicated by a line 5—5 in FIG. 2.
Figure 6:
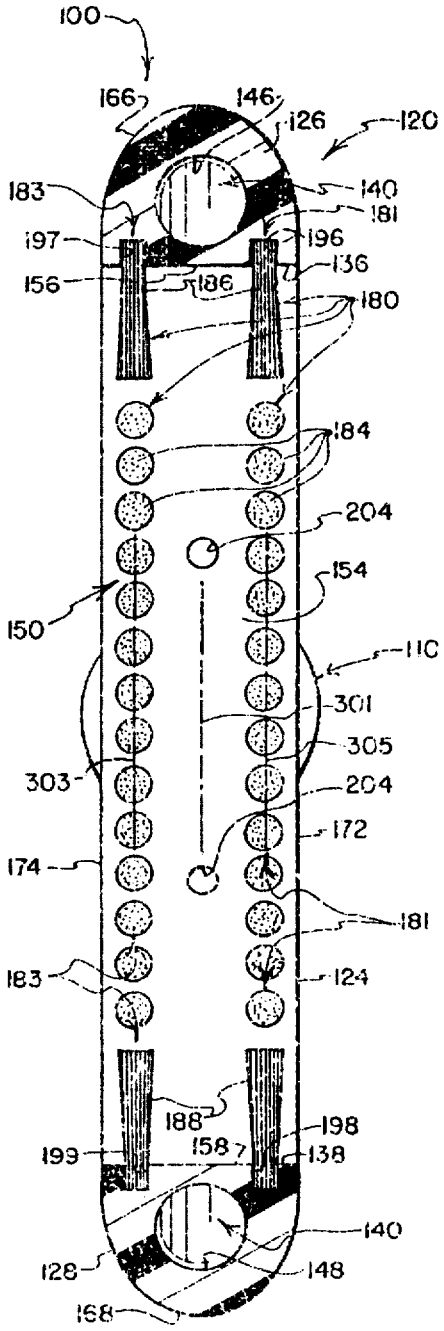
FIG. 6 is a cross-sectional view showing portions of the head and portions of the underlying handle, as seen from a plane indicated by a line 6—6 in FIG. 2; and, FIG. 7 is a perspective view of an alternate embodiment of the nozzle having a head that is substantially identical to the head of the nozzle embodiment shown in FIG. 1 but having a more extensively tapered handle than does the nozzle embodiment of FIG. 1, with bristles of the head shown engaging portions of a ceiling fan blade, and with lower portions of the handle shown releasably connected to and communicating with an end region of a conventional vacuum cleaner hose.

Referring to FIGS. 1, 3 and 4, the top bar 122 has a rounded top surface 162 that is configured substantially the same as a rounded bottom surface 164 that is defined by the bottom bar 124. Referring to FIGS. 1, 5 and 6, the left bar 126 has a rounded left surface 166 that is configured substantially the same as a rounded right surface 168 that is defined by the right bar 128. Referring to FIGS. 1 and 3–6, the bars 122, 124, 126, 128 also cooperate to define gently curved, substantially identically shaped front and rear faces 170, 172 of the head 120 that join smoothly with the top, bottom, left and right surfaces 162, 164, 166, 168.

In preferred practice, the handle 110 joins with the bottom bar 124 mid-way along the length of the bottom bar 124, and the above-described features of the handle 110 and head 120 are arranged and configured so that the nozzle 100 is left-and-right symmetrical and front-and-rear symmetrical about a center axis of the handle 110, indicated generally by the numeral 111 in FIGS. 2 and 3. Likewise, the afore-described features of the head 120 are arranged and configured so that the head 120 is top-and-bottom symmetrical about a left-and-right extending center plane of the head 120, indicated generally by the numeral 121 in FIGS. 2, 3 and 4.

Referring to FIGS. 3–6, the bristles 180 are essentially divided into two groups, namely a front group indicated generally by the numeral 181, and a rear group indicated generally by the numeral 183. The bristles of the front group 181 are spaced inwardly (within the blade passage 150) from the front face 172 by only a short distance. The bristles of the rear group 183 are spaced inwardly (within the blade passage 150) from the rear face 174 by only a short distance.

Half of the upper bristles 182, half of the lower bristles 184, half of the left bristles 186, and half of the right bristles 188 comprise the front group 181. Half of the upper bristles 182, half of the lower bristles 184, half of the left bristles 186, and half of the right bristles 188 comprise the rear group 183.

The bristles that comprise each of the front and rear groups 181, 183 may be formed from a wide range of materials, may be of a wide range of diameters, and typically include a greater number of bristles if the bristle diameters are relatively small than if the bristle diameters are relatively large. The bristles that comprise each of the groups 181, 183 should be selected to be of sufficient length, strength and stiffness to engage and brush surfaces of a ceiling fan blade that is inserted through the blade passage 150 (as the blade 1200 is shown inserted through the blade passage 1150 in FIG. 7) to loosen and dislodge dust, cobwebs and the like that tend, with time, to accumulate on the blade surfaces in a residential dwelling environment—so that the vacuum action of the nozzle 100 can pick up this loosened and dislodged foreign matter for withdrawal into the vacuum chamber 140, and thence into the hollow interior of the handle 110. The spacing between the front and rear groups 181, 183 of the bristles 180 should be sufficient to ensure that the bristles 180 themselves do not offer resistance within the space between the bristle groups 181, 183 to the vacuum action of the nozzle 100 in carrying away the loosened foreign matter, and in removing and ducting away dust and other foreign matter from the blade surfaces.

As those who are skilled in the art will readily understand, bristles suitable for use with the nozzle 100 can take many forms—and hence, their exact make-up is not critical to the present invention so long as they perform their intended function. Important to the invention, however, is the realization that optimum performance is achieved by utilizing two spaced groups 181, 183 of bristles 180 that are located near opposite ends of the blade passage 150, with sufficient space between the bristle groups 181, 183 to ensure that the vacuum action of the nozzle has adequate room to perform its purpose, but with the spacing between the groups 181, 183 not being so great that the vacuum action of the nozzle fails to withdraw, with reasonable effectiveness, from among the bristles 180 such dust and other foreign matter as is loosened and moves into spaces among the bristles 180 while the bristles 180 are performing their wiping and/or brushing function.

To connect the front bristles 181 to the head 120, front sets of holes 192 (FIG. 4), 194 (FIG. 4), 196 (FIGS. 5 & 6), 198 (FIGS. 5 & 6) are formed in surfaces 132, 134, 136, 138, respectively, to receive groups of outer ends of the front bristles 181, which are adhered or otherwise bonded in place. Likewise, to connect the rear bristles 183 to the head 120, rear sets of holes 193 (FIG. 4), 195 (FIG. 4), 197 (FIGS. 5 & 6), 199 (FIGS. 5 & 6) are formed in the surfaces 132, 134, 136, 138, respectively, to receive groups of outer ends of the rear bristles 183, which are adhered or otherwise bonded in place.

Referring to FIG. 2, the blade passage 150 communicates with the vacuum chamber 140 by means of holes (also referred to herein by the term "vacuum openings") 202 (see also FIG. 5), 204 (see also FIG. 6), 206 (see also FIGS. 3 and 4), 208 that are formed in the top, bottom, left and right surfaces 132, 134, 136, 138, respectively, of the head 120. Since a majority of the dust that collects on a ceiling fan blade collects on the blade's top surface (such as the top surface 1202 depicted in FIG. 7), the top holes 202 preferably provide several vacuum openings through which dust can be drawn from the passage 150 into the upper leg 142 of the vacuum chamber 140.

Since ample dust, cobwebs and the like also may collect along leading and trailing edges of ceiling fan blades (such as the left and right surfaces 1206, 1208 depicted in FIG. 7), the left and right holes 206, 208 preferably include at least two left holes 206 (that preferably are spaced symmetrically about the center plane 121), the right holes 208 preferably include at least two right holes 208 (that preferably are identical to the left holes 206 and preferably are spaced identically, symmetrically about the center plane 121), and the holes 206, 208 preferably are larger in cross-sectional area than are the holes 204—to ensure that proper vacuum force is applied to draw dust, cobwebs and the like from blade edge surfaces and into the vacuum chamber legs 146, 148.

Since relatively little dust tends to collect near bottom surfaces of ceiling fan blades (such as the bottom surface 1204 depicted in FIG. 7), only a limited number of bottom holes 204 which are of relatively small cross section (preferably of about the same size as the top holes 202) are needed to draw this dust into the bottom leg 144 of the vacuum chamber 140.

In preferred practice, delivering a maximum of vacuuming action to top surface portions of a fan blade that is inserted through the blade passage 150 of the nozzle 100 preferably is promoted both by 1) ensuring that a substantially uniform vacuum pressure is held throughout the vacuum chamber 140, and 2) by providing top bar vacuum openings 202 (that communicate the vacuum chamber 140 with top portions of the blade passage 150) that have a total cross-sectional area that bears a proper relationship to the total cross-sectional areas of other vacuum openings 204, 206, 208 that are defined by each of the bottom bar 124 the left end structure 126 and the right end structure 128 of the nozzle head 120.

A "rule of thumb" that preferably is used to guide the determination of the cross-sectional area of the vacuum chamber 140, and that preferably is used to determine the size and number of vacuum openings 202, 204, 206, 208 along each of the four sides of the blade passage 150 is as follows:

1) The cross-sectional area of the vacuum chamber 140 (as taken transversely to one of the chamber's longitudinally extending portions, as is depicted in FIGS. 3 and 4 where circular cross-sections of the longitudinally extending chamber portions 142, 144 are shown, or as is depicted in FIGS. 5 and 6 where circular cross-sections of the longitudinally extending chamber portions 146, 148 are shown) preferably does not diminish at any point along the endless length thereof to a cross-sectional area that is less than one half the total cross-sectional areas of all of the top, bottom, left and right vacuum openings 202, 204, 206, 208 that communicate the vacuum chamber 140 with the blade passage 150—which helps to ensure that each of the left and right halves of the vacuum chamber 140 are capable of delivering adequate vacuuming capability to their associated "half" of the vacuum openings 202, 204, 206, 208. By way of example, if the vacuum chamber 140 has a substantially uniform (and minimum) diameter of 17 mm, this gives the chamber 140 (a typical minimum) cross-sectional area of about 227 $mm^2$—which is slightly greater than one half of the total cross-sectional area of 427 mm which obtains if the top bar 122 uses six (6) vacuum openings 202 that each are of 6 mm diameter, if each of the end structures 126, 128 uses two (2) vacuum openings 206, 208 that each are of 8 mm diameter, and if the bottom bar 124 has two (2) vacuum openings 204 that each are of 6 mm diameter.

2) The total cross-sectional area of the vacuum openings 202 formed in the top bar 122 is greater than the total cross-sectional area of each of a) the vacuum openings 204 formed in the bottom bar 124, b) the vacuum openings 206 formed in the left end structure 126, and c) the vacuum openings 208 formed in the right end structure 128—which arrangement helps to ensure that a greater abundance of vacuuming capability is provided by the top vacuum openings 202 along top surface portions of the blade than along any of the other blade surfaces. Using vacuum openings of the size and number set out in the above example, the total cross-sectional area of six (6) top openings 202 of 6 mm size is 196.56 $mm^2$—which is greater than the cross-sectional area of either the two (2) 8 mm left end openings 206 or the two (2) 8 mm right end openings 208 (each pair of which has a total cross-sectional area of 100.48 $mm^2$), which is greater than the cross-sectional area of the two (2) 6 mm bottom bar openings 204 (which feature a total cross-sectional area of 56.2 $mm^2$).

3) The total cross-sectional areas of the vacuum openings 206 formed in the left end structure 126 and the vacuum opening 208 formed in the left right end structure 128 are substantially equal to each other, and each is greater than the total cross-sectional area of the vacuum openings 204 formed in the bottom bar 124—which helps to ensure that edge surfaces of a blade inserted into the blade passage 150 receive a greater concentration of vacuuming action than does the bottom surface of the blade; and, 4) The vacuum openings 204 formed in the bottom bar 124 of the head 120 are spaced and positioned along the length of the bottom bar such that half of their total cross-sectional area is located to the left and half to the right of the bottom-bar-to-handle juncture—and, in this and in all other ways, the size, number and location of the vacuum openings 202, 204, 206, 208 is preferably selected so as to provide symmetry (preferably about the central axis 111 of the elongate handle 110) of features of the head 120.

In operation, a handle 110 of the nozzle 100 is connected to an end region of a suitably sized conventional vacuum cleaner hose (as is depicted in FIG. 7 wherein the handle 1110 is shown connected to a vacuum cleaner hose 1250) so that the hose can draw a vacuum within the handle 110 and within the vacuum chamber 140, which causes air from within the blade passage 150 to be drawn through the vacuum holes 202, 204, 206, 208 into the chamber for evacuation through the handle 110—with this flow of air being evacuated from the blade passage 150 causing dust, cobwebs, and the like loosened from blade portions extending through the blade passage 150 and brushed by the bristles 180 to be cleaned from the blade surfaces.

Referring finally to FIG. 6, one set of features of the preferred practice of the present invention resides in the provision of a nozzle for cleaning ceiling fan blades that utilizes a handle-carried head 120 which defines a vacuum chamber 140 that surrounds a generally rectangular cross-section blade passage 150, with communication between the blade passage 150 and the vacuum chamber 140 being provided solely by means of a judicious arranged and sized set of vacuum openings (including the openings 202, 206 and 208 which do not appear in FIG. 6, together with the openings 204 that are shown in FIG. 6, all of which are) arranged to extend in a common central plane of the head 120 which is indicated by the numeral 301, and which intersects the blade passage 150 substantially mid-way along its length and at a position that is spaced substantially equidistantly between planes that are indicated by the numerals 303, 305 within which the front and rear groups 181, 183 of the bristles 180 extend, respectively—by which arrangement it will be understood that the vacuum action that is introduced into the blade passage 150 by the discrete openings 202, 204, 206, 208 (all of which preferably extend within the common center plane 301) can perform its function of collecting and ducting dust, cobwebs and the like from the blade passage 150 into the vacuum chamber 140 without having the operation of this vacuuming action inhibited by, diminished by or interfered with by a too-close-proximity presence of the front and rear groups 181, 183 of the bristles 180 (which reside within the planes 303, 305 that preferably are spaced equidistantly from the plane 301 by distances that are not so great as to prevent the vacuuming action from withdrawing with satisfactory effectiveness from among the bristles 180 such dust and the like as may be loosened by the wiping and/or brushing action of the bristles 180 as the head 120 is moved along blade surfaces of a blade that is inserted through the blade passage 150.

While such terms as "top," "bottom," "left," "right," "horizontal," "vertical" and the like are utilized herein, it will be understood that such terms are used merely to aid the reader in referring to features in the orientations in which they are depicted in the accompanying drawings, and are not to be construed as limiting the scope of the claims that follow.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty exist in the invention.

What is claimed is:

1. A vacuum nozzle for attachment to a vacuum cleaner hose for vacuum cleaning top, bottom, left and right surfaces of a ceiling fan blade that is inserted through a blade passage which is defined by the nozzle, comprising:

a) an elongate, tubular handle having an open end that is connectible to a vacuum hose for having a vacuum drawn in a hollow interior of the tubular handle when a vacuum is drawn in a vacuum hose connected to the open end of the handle;

b) a generally rectangular head connected to an opposite end of the tubular handle and having 1) an interior wall that defines a blade passage of generally rectangular cross section that has opposed front and rear ends and that is sized to loosely receive therein portions of a ceiling fan blade that are to be cleaned, and 2) exterior walls that cooperate with the interior wall to define a generally rectangular vacuum chamber that surrounds the blade passage, with exterior walls including spaced front and rear walls that connect with the interior wall at the front and rear ends of the blade passage, respectively, with the interior wall serving to segregate the vacuum chamber from the blade passage, and with the connection of the head to the handle being configured to communicate the hollow interior of the tubular handle with the vacuum chamber so that a vacuum will be drawn in the vacuum chamber when a vacuum is drawn in the hollow interior of the tubular handle;

c) wherein the interior wall has portions that include 1) relatively long top and bottom walls that define top and bottom sides of the blade passage, and 2) left and right walls that extend between overlying left and right ends, respectively, of the top and bottom walls, and that define left and right ends of the blade passage;

d) discrete, spaced-apart vacuum openings formed through the interior wall so as to communicate the vacuum chamber with the blade passage at a plurality of locations situated substantially mid-way between the front and rear ends of the blade passage, including top holes formed through the top wall, bottom holes formed through the bottom wall, left holes formed through the left wall, and right holes formed through the right wall, whereby, when a vacuum is drawn in the vacuum chamber, air will be caused to flow from the blade passage through the vacuum openings into the vacuum chamber such that a vacuuming action will be experienced by portions of a ceiling fan blade that is inserted into the blade passage such that 1) a top surface of the inserted blade portions faces toward the top holes, 2) a bottom surface of the inserted blade portions faces toward the bottom holes, 3) a left surface of the inserted blade portions faces toward the left holes, and 4) a right surface of the inserted blade portions faces toward the right holes;

e) front bristle means for perimetrically engaging the inserted blade portions along top, bottom, left and right surfaces thereof near where the top, bottom, left and right surfaces thereof extend through the front end of the blade passage;

f) rear bristle means for perimetrically engaging the inserted blade portions along top, bottom, left and right surfaces thereof near where the top, bottom, left and right surfaces thereof extend through the rear end of the blade passage; and, g) with the vacuum openings being configured and arranged to deliver a greater measure of vacuuming action through the top, left and right holes to the top, left and right surfaces of the inserted blade portions than is delivered by the bottom holes to the bottom surface of the inserted blade portions.

2. The vacuum nozzle of claim 1 wherein the total cross-sectional area of the top holes is greater than the total cross-section area of the left holes, and the total cross-sectional area of the left holes is substantially equal to the total cross-sectional area of the right holes.

3. The vacuum nozzle of claim 1 wherein the interior and exterior walls define a head that is substantially symmetrical about an imaginary center axis that centrally intersects the top and bottom walls, wherein the bristles of the front bristle means and the rear bristle means are arranged symmetrically about said axis, and wherein the vacuum openings also are arranged symmetrically about said axis.

4. The vacuum nozzle of claim 3 wherein the handle connects with the head at a location along said axis that is beneath the blade passage.

5. The vacuum nozzle of claim 1 wherein the vacuum chamber has a generally uniform cross-section along its length as it extends about the blade passage, which cross-section is at least as great as one half of the total cross-sectional area of the top holes, the bottom holes, the left holes and the right holes.

6. The vacuum nozzle of claim 1 wherein the the vacuum openings include 1) at least six of the top holes that each are of a substantially uniform first diameter and that are substantially equally spaced along a major portion of the top wall, 2) at least one each of the right and left holes that all are of a substantially uniform second diameter, and 3) at least two of the bottom openings that each are of a substantially uniform third diameter.

7. A vacuum nozzle for attachment to a vacuum hose for cleaning ceiling fan blades, comprising:

a) an elongate, tubular handle having an open end that is connectible to a vacuum hose;

b) a hollow, generally rectangular head connected to an opposite end of the tubular handle, wherein the head has spaced front and rear walls, and has an interior wall that extends between the front and rear walls to define a blade passage of generally rectangular cross-section that extends transversely with respect to a longitudinally extending center axis of the handle, with the blade passage 1) having a front end where the blade passage opens through the front wall, 2) having a rear end where the blade passage opens through the rear wall, and 3) being of a size that will permit a cross-section of a blade of a ceiling fan to pass loosely therethrough;

c) wherein the head has top, bottom, left and right portions that cooperate to extend perimetrically about top, bottom, left and right portions of the blade passage, respectively, and that include spaced, substantially parallel-extending top and bottom bars that have overlying left and right ends which are connected by left and right end structures;

d) wherein the top and bottom bars and the left and right end structures all have hollow interiors that cooperatively communicate to define a generally rectangular vacuum chamber that extends perimetrically about the blade passage, wherein the top and bottom bars and the left and right end structures respectively define top, bottom, left and right portions of the interior wall that cooperate to segregate the vacuum chamber from the blade passage;

e) wherein the top and bottom bars and the left and right end structures also respectively define discrete top, bottom, left and right vacuum openings that extend respectively through the top, bottom, left and right portions of the interior wall, said vacuum openings extending in a common center plane of the head that resides along the longitudinally extending center axis of the handle and communicating the vacuum chamber and the blade passage; and, f) wherein the top and bottom bars and the left and right end structures also respectively carry top, bottom, left and right bristles that extend respectively into top, bottom, left and right portions of the blade passage, with half of the top bristles, half of the bottom bristles, half of the left bristles and half of the right bristles comprising a front set of bristles that extend principally within a front plane that parallels the common center plane and intersects the blade passage near the front end thereof, and with the other halves of the top, bottom, left and right bristles comprising a rear set of bristles that extend principally within a rear plane that parallels the common center plane and intersects the blade passage near the rear end thereof.

8. The vacuum nozzle of claim 7 wherein the top bristles are connected to the top wall portion near front and rear ends thereof, the bottom bristles are connected to the bottom wall portion near front and rear ends thereof, the left bristles are connected to the left wall portion near front and rear ends thereof, and the right bristles are connected to the right wall portion near front and rear ends thereof.

9. The vacuum nozzle of claim 7 wherein the top openings have a total cross-sectional area that is greater than is the total cross-section area of the left openings, and the total cross-sectional area of the left openings is substantially equal to the total cross-sectional area of the right openings.

10. The vacuum nozzle of claim 7 wherein the head is substantially symmetrical about an imaginary center axis that centrally intersects the top and bottom walls, wherein the bristles of the front bristle means and the rear bristle means are arranged symmetrically about said axis, and wherein the vacuum openings also are arranged symmetrically about said axis.

11. The vacuum nozzle of claim 10 wherein the handle connects with the head at a location along said axis that is beneath the blade passage.

12. The vacuum nozzle of claim 7 wherein the vacuum chamber has a generally uniform cross-section along its length as it extends about the blade passage, which cross-section is at least as great as one half of the total cross-sectional area of the top openings, the bottom openings, the left openings and the right openings.

13. The vacuum nozzle of claim 7 wherein the the vacuum openings include 1) at least six of the top openings that each are of a substantially uniform first diameter and that are substantially equally spaced along a major portion of the top wall, 2) at least one each of the right and left openings that all are of a substantially uniform second diameter, and 3) at least two of the bottom openings that each are of a substantially uniform third diameter.

14. A nozzle for vacuuming dust from top, bottom and opposed edge surfaces of a ceiling fan blade, comprising:

a) an elongate tubular handle for ducting dust into a vacuum hose when a vacuum hose is connected to one end region of the tubular handle;

b) a hollow, generally rectangular shaped head defined by spaced, overlying, tubular top and bottom bars having overlying left end regions connected and communicated by a transversely extending tubular left bar, and that have overlying right end regions connected and communicated by a transversely extending tubular right bar, with the top, bottom, left and right bars 1) having front portions that cooperate to define a front surface of the head, 2) having rear portions that cooperate to define an opposed rear surface of the head, 3) extending perimetrically about a blade passage of generally rectangular cross-section that has opposed front and rear ends that open through the the front and rear surfaces, respectively, and 4) having their hollow interiors communicated to cooperatively define a vacuum chamber that extends perimetrically about the blade passage at a location substantially midway along the length of the blade passage, with the blade passage being of a sufficient cross-sectional size to permit portions of a ceiling fan blade to be inserted therein and to move therethrough with a top surface of the blade facing toward a top surface of the blade passage that is defined by a bottom portion of the top bar, with a bottom surface of the blade facing toward a bottom surface of the blade passage that is defined by a top portion of the bottom bar, and with opposed left and right surfaces of the blade facing toward opposed transversely extending sides of the blade passage that are defined by interior portions of the left and right bars;

c) a front array of bristles carried by the head at a front location near where the front end of the blade passage opens through the front surface and extending perimetrically about the blade passage at the front location, and a rear array of bristles carried by the head at a rear location near where the rear end of the blade passage opens through the rear surface and extending perimetrically about the blade passage at the rear location;

d) a central array of vacuum openings communicating the vacuum chamber with the blade passage for ducting a flow of dust and air from the blade passage into the vacuum chamber, with the openings of the central array including top, bottom, left and right openings formed respectfully through the top, bottom, left and right surfaces of the passage, which array is situated substantially equidistantly between the front array of bristles and the rear array of bristles; and, e) with the top openings having a combined cross-sectional area that is greater than the combined cross-sectional area of each of the left and right openings, and with the cross-sectional areas of each of the left and right openings being greater than the combined cross-sectional area of the bottom openings.

15. The nozzle of claim 14 wherein each of the front and rear arrays of bristles includes top bristles carried by the top surface, bottom bristles carried by the bottom surface, left bristles carried by the left surface, and right bristles carried by the right surface.

16. The nozzle of claim 14 wherein the head connects mid-way along its length with the handle, wherein the head is configured to be symmetrical about an imaginary center axis that centrally intersects the top and bottom surfaces, wherein the bristles of the front bristle means and the rear bristle means are arranged symmetrically about said axis, and wherein the vacuum openings also are arranged symmetrically about said axis.

17. The vacuum nozzle of claim 16 wherein the handle connects with the head at a location along said axis that is beneath the blade passage.

18. The vacuum nozzle of claim 14 wherein the vacuum chamber has a generally uniform cross-section along its length as it extends about the blade passage, which cross-section is at least as great as one half of the total cross-sectional area of the top openings, the bottom openings, the left openings and the right openings.

19. The vacuum nozzle of claim 14 wherein the the vacuum openings include 1) at least six of the top openings that each are of a substantially uniform first diameter and that are substantially equally spaced along a major portion of the top wall, 2) at least one each of the right and left openings that all are of a substantially uniform second diameter, and 3) at least two of the bottom openings that each are of a substantially uniform third diameter.

20. The vacuum nozzle of claim 19 wherein there are only two left openings and only two right openings, and all of the second diameter of the left and right openings is greater than the first diameter of the top openings.

* * * * *